United States Patent [19]

Herdeg et al.

[11] Patent Number: 4,682,552

[45] Date of Patent: Jul. 28, 1987

[54] DISPLACEABLE APPARATUS FOR PROCESSING PALLETS IN AN AUTOMATIC SEWING MACHINE

[75] Inventors: Donald F. Herdeg, South Hamilton; Lawrence P. Ciccia, Medford, both of Mass.

[73] Assignee: USM Corporation, Farmington, Conn.

[21] Appl. No.: 873,741

[22] Filed: Jun. 12, 1986

[51] Int. Cl.[4] ..... D05B 21/00; D05C 9/04

[52] U.S. Cl. ..... 112/121.12; 112/2

[58] Field of Search ..... 112/121.12, 121.11, 112/121.15, 121.29, 2, 102, 103, 104, 306

[56] References Cited

U.S. PATENT DOCUMENTS

| | | | |
|---|---|---|---|
| 3,762,348 | 10/1973 | Junemann | 112/121.12 |
| 3,769,924 | 11/1973 | Rogers et al. | 112/121.12 X |
| 3,895,590 | 7/1975 | Perlino | 112/121.12 |
| 4,305,338 | 12/1981 | Adamson | 112/121.12 X |
| 4,336,761 | 6/1982 | Magnan | 112/121.12 |
| 4,422,393 | 12/1983 | Johnson et al. | 112/121.15 |
| 4,455,952 | 6/1984 | Morin et al. | 112/121.15 X |
| 4,479,446 | 6/1984 | Johnson et al. | 112/121.12 |

*Primary Examiner*—H. Hampton Hunter

*Attorney, Agent, or Firm*—William F. White

[57] ABSTRACT

Apparatus is disclosed for processing workpieces prearranged within pallets in an automatic sewing machine system. The apparatus is displaceable from fixed positions wherein the pallets are normally processed from an input location to a sewing location and hence to an output location. The displaced apparatus allows access to various portions of the automatic sewing machine system.

11 Claims, 5 Drawing Figures

DISPLACEABLE APPARATUS FOR PROCESSING PALLETS IN AN AUTOMATIC SEWING MACHINE

FIELD OF THE INVENTION

This invention relates to the handling of workpieces sewn by an automatic sewing machine system. In particular, this invention relates to apparatus for processing pallets containing the workpieces.

BACKGROUND OF THE INVENTION

An automatic sewing machine system which processes pallets containing workpieces is illustrated in U.S. Pat. No. 4,422,393 entitled "Sewing Machine Having Automatic Pallet Handling". This system processes pallets from an input location to a sewing location and thereafter to a remote location wherein a further pallet may be automatically processed from the input location to the sewing location. The processing of pallets to the sewing location is accomplished by a set of rotatable shelves that cooperate in a manner which allows first one edge of a pallet to be dropped before a second edge is dropped to the sewing location. The thus dropped pallet is locked to a carriage which is movable in the X and Y directions relative to a reciprocating sewing needle so as to thereby produce a desired stitch pattern on the workpiece. The completed workpiece within the pallet is returned to the location for receiving a dropped pallet from the input location. At this point, the pallet is unlocked from the automatic positioning system. A further mechanism, external to the automatic positioning system, releases an underlying support for the pallet. This allows the pallet to be engaged by an ejector mechanism which moves the pallet to a remote location so as to thereby allow another pallet to be attached to the automatic positioning system.

The aforementioned mechanisms for processing a pallet comprises a number of complex, interdependent mechanisms. The number and complexity of these interdependent mechanisms can interfere with accessing various portions of the sewing machine system. In particular, the structure for supporting the rotatable shelves at the input location occupies space directly in front of the automatic sewing machine. The ejector mechanism also occupies other space in front of the automatic sewing machine. Still other portions of the space in front of the automatic sewing machine are occupied by additional structure not shown in U.S. Pat. No. 4,422,393. This additional structure may include a control console for the automatic sewing machine system. This latter structure in combination with the support structure for the shelves can make access to various portions of the system particularly difficult.

OBJECT OF THE INVENTION

It is an object of the invention to provide pallet handling apparatus within an automatic sewing machine system that provides quick and easy access to various portions of the system.

SUMMARY OF THE INVENTION

The above and other objects are achieved according to the present invention by pallet handling apparatus having a pair of rotatable shelves that receive and thereafter drop the pallet to a carriage associated with the automatic positioning system. One of the rotatable shelves is mounted within support structure that may be easily displaced for further access to the automatic sewing machine. The thus dropped pallet is locked to the carriage for automatic sewing and returned to a location under the rotatable shelves. The locking is released and the pallet is allowed to drop unto a pair of inclined chutes. The inclined chutes are supported at a predefined angle of inclination by supports which are detachably mounted to a base of the system. Removal of the supports allows still further access to various portions of the automatic sewing machine.

BRIEF DESCRIPTION OF THE DRAWINGS

The above and other features of the invention will now be particularly described with reference to the accompanying drawings, in which.

DESCRIPTION OF THE PREFERRED EMBODIMENT

Figure 1:
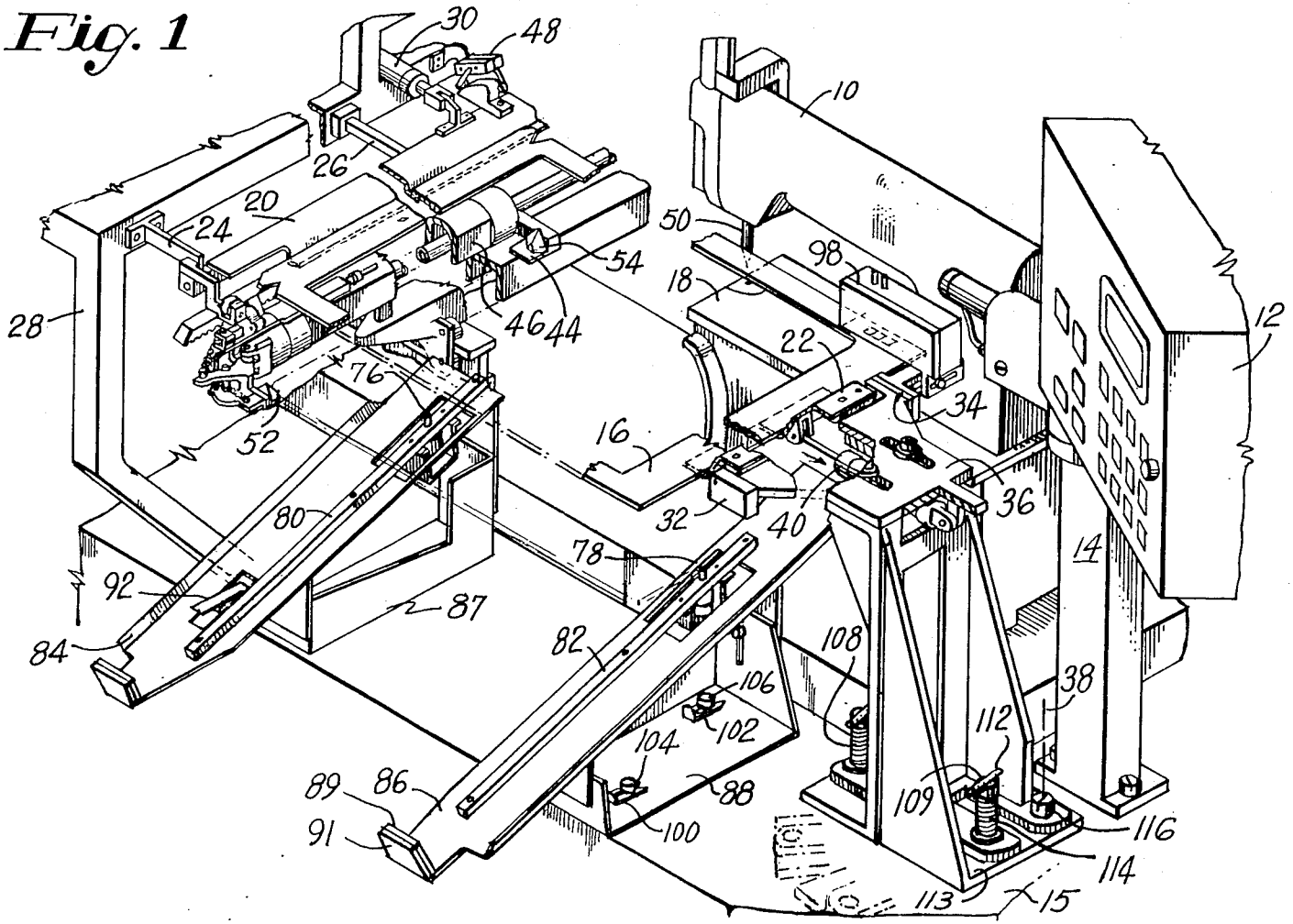
FIG. 1 is an overall perspective view of an automatic sewing machine system having an automatic pallet handling apparatus in association with an automatic positioning system.

Referring to FIG. 1, an automatic sewing machine system having apparatus for processing pallets with respect to a sewing machine 10 is generally shown. A control panel 12 mounted in front of the automatic sewing machine 10 is generally illustrated. The control panel 12 is situated on a panel support 14 which extends upwardly from a fixed base 15.

A pallet 16 is suspended above a bed 18 of the sewing machine 10 by a pair of rotatable shelves 20 and 22. The shelf 20 is rotatably supported within mounts 24 and 26 extending outwardly from a frame 28 attached to the fixed base 15. The shelf 20 is rotated within the mounts 24 and 26 by a pivotally connected actuator 30. The shelf 22 is rotatably supported within side mounts 32 and 34 forming part of a horizontal support structure 36 which is fastened to a vertical support structure 38. The shelf 22 is rotated within the side mounts 32 and 34 by a pivotally connected actuator 40. The actuator 40 is itself pivotally suspended from the horizontal support structure 36.

Figure 2:
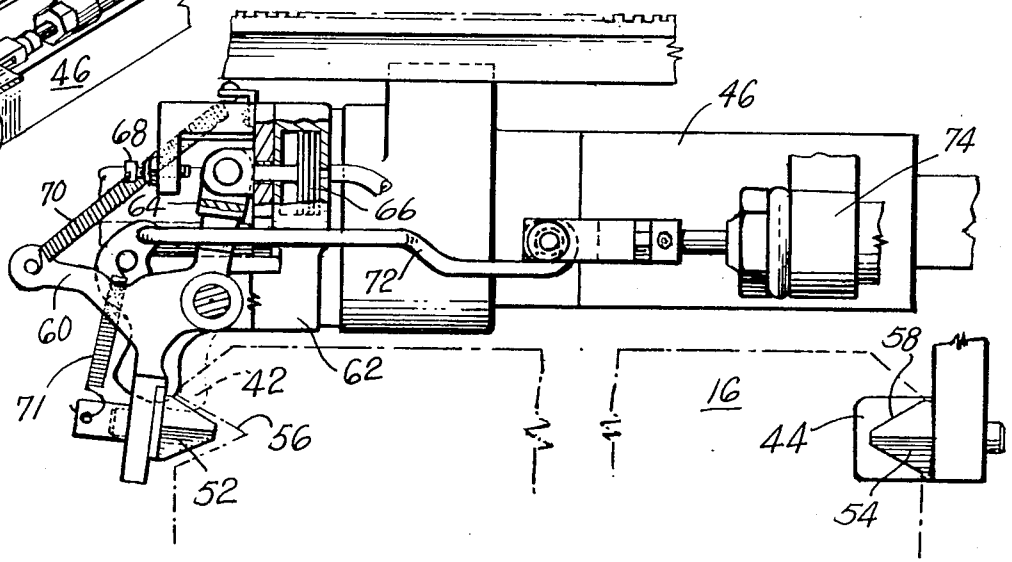
FIG. 2 is a plan view of a pallet in association with the carriage mechanism of the automatic positioning system.

The left edge of the pallet 16 is first dropped by a downward rotation of the shelf 20. The thus dropped edge will come to rest on a pair of support tabs 42 and 44 associated with a movable carriage 46 that has been previously positioned underneath the shelf 20. The support tabs 42 and 44 are clearly shown in FIG. 2. It is to be noted that the support tab 42 is movable whereas the support tab 44 is fixed relative to the carriage 46.

Figure 3:
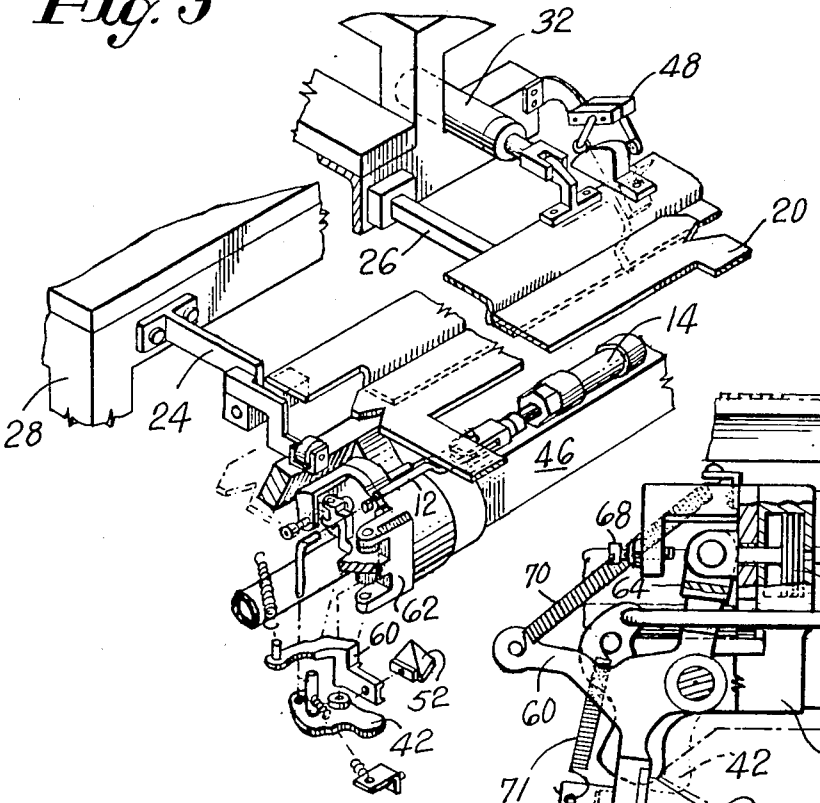
FIG. 3 is a perspective view of a portion of the automatic pallet handling apparatus.

Referring again to FIG. 1, a sensor switch 48 is operative to detect the downward motion of the shelf 20 so as to thereafter trigger the actuator 40 to retract, thereby causing the shelf 22 to move downwardly. The right edge of the pallet 16 now drops down to the bed 18 of the sewing machine. This causes the pallet 16 to lie in a substantially horizontal plane relative to a reciprocating sewing needle 50. Once the pallet 16 has assumed the aforementioned horizontal position, it is clamped between a pair of wedges 52 and 54 which engage a pair of notches 56 and 58. This wedge engagement of the respective notches is clearly shown in FIG. 2. In this regard, the wedge 52 is illustrated during the course of its movement into engagement with the notch 56. The mechanism by which the wedge 52 is thus moved into engagement is clearly illustrated in both FIGS. 2 and 3. The wedge 52 is attached to a pivotal lever 60 which rotates within a fixture 62 forming part of the casting for the carriage 46. Only a portion of the pivotal lever 60 is illustrated within the fixture 62 in FIG. 3. This portion is seen to include an arm 64 pivotally connected to an output shaft of a pneumatic actuator 66. The pneumatic actuator 66 is operative to move the arm 64 outwardly into contact with an adjustable limit stop 68. This outward movement of the arm 64 is against the bias force of a spring 70. This causes the pivot lever 60 to rotate within the fixture 62 so as to thereby cause the wedge 52 to move inwardly into engagement with the notch 56. The wedge 52 ultimately seats in the notch 56 and urges the opposing notch 58 against the opposing wedge 54. A spring 71, connected to the wedge 52, retains the support tab 42 underneath the pallet 16. The thus clamped pallet can be positioned by the carriage 46 relative to the reciprocating sewing needle 50. It is to be understood that positioning systems for moving carriages relative to reciprocating sewing needles are well known in the art. The X, Y positioning system used in the preferred embodiment is disclosed in detail in U.S. Pat. No. 4,406,234 entitled "Positioning Apparatus".

Following completion of automatic sewing, the carriage 46 is returned to a position underneath the shelf 20. At this point in time, the pneumatic actuator 66 is exhausted so as to thereby cause the bias spring 70 to disengage the wedge 52 from the notch 56. The support tab 42 is next rotated outwardly by a pivotably connected link 72 connected to a pressurized pneumatic actuator 74. The front edge of the pallet 16 drops downwardly as soon as the support tab 42 rotates sufficiently outwardly so as to no longer support the pallet 16. The rear edge of the pallet remains temporarily supported by the support tab 42 and the bed 18 of the sewing machine. Referring to FIG. 1, the front of the pallet drops onto a pair of shock absorbing pins 76 and 78. The shock absorbing pins absorb the free fall impact of the front portion of the pallet which thereafter descends down a pair of inclined slides 80 and 82. The inclined slides are preferably lengths of hard, polished steel having widths of one-half inch which produce minimal frictional resistance to the underside of the sliding pallet. The inclined slides 80 and 82 are mounted within chutes 84 and 86 which are in turn mounted at an inclined angle on supports 87 and 88. The inclined angle is preferably twenty-five degrees with respect to the horizontal surface of the base 15. This inclined angle is sufficient to allow the front edge of the pallet 16 to slide downwardly so as to thereby release the rear edge of the pallet from the support tab 44 and the bed 18 of the sewing machine. The pallet continues to slide downwardly until its front edge contacts one quarter inch thick rubber pads, i.e. 89 located on the inner side of abutments 90 and 91. At this point in time, the pallet will no longer remain on the shock absorbing pins 76 and 78. A contact switch 92 will be moreover closed so as to indicate that a pallet is resting in the chutes 84 and 86.

Figure 4:
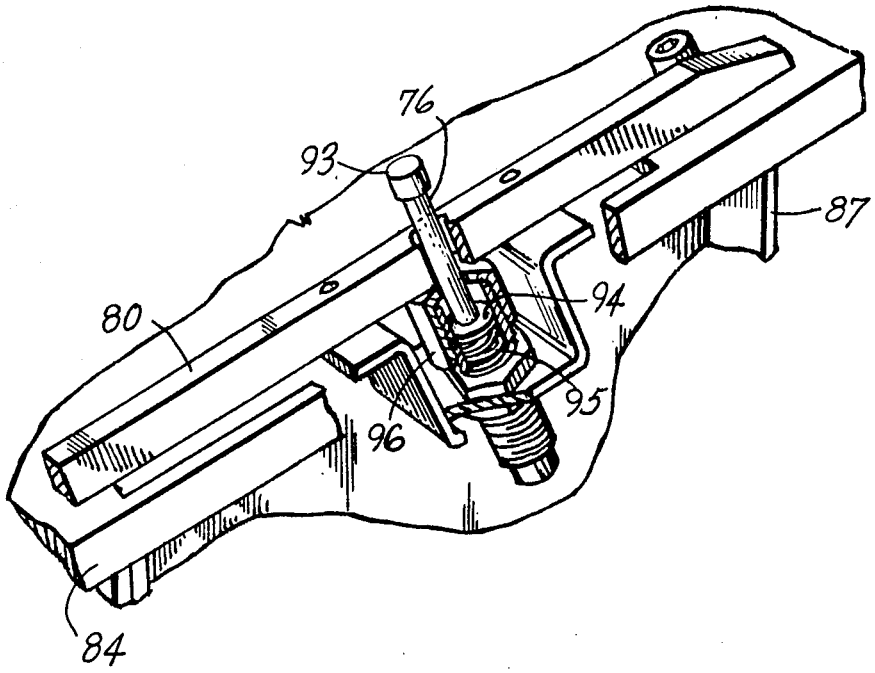
FIG. 4 is a perspective view of a portion of the pallet handling apparatus which absorbs the impact of the front portion of a dropped pallet.

Referring to FIG. 4, the shock absorbing pin 76 is illustrated in further detail relative to the slide 80. The pin 76 is seen to project upwardly through a hole in the slide 80 so as to contact the underside of the pallet. A soft plastic cap 93 is preferably affixed to the top of the pin 76 so as to provide a cushioned initial contact with the underside of the pallet. The aft end of the pin 76 is connected to a piston head 94 resting on a helical spring 95 within a cylindrical housing 96. The cylindrical housing 96 is filled with a fluid that flows through orifices in the piston head 94. In this manner, impact force is absorbed by the piston head 94 moving against both the helical spring 95 and the fluid dampening resistance within the cylinder 96. It is to be noted that the downward travel of the piston head 94 is sufficient to allow the soft plastic cap 93 to move completely into the hole within the slide 80. This produces a flush relationship between the top of the soft plastic cap 93 and the top surface of the slide 80. The underside of a pallet will hence move smoothly down the slides 80 and 82 over the suppressed plastic caps associated with the pins 76 and 78.

Referring again to FIG. 3, the shelves 20 and 22 will have been reset following the dropping of the pallet 16 to the carriage 46. Another pallet may have been loaded onto the shelves while the workpiece in the pallet 16 was being sewn. The presence of this pallet will be detected by a detection device 98.

The newly loaded pallet whose presence has been detected will be dropped to the carriage 46 in response to the switch 92 sensing the presence of the pallet 16 in the chutes 84 and 86. The support tab 26 will have been previously rotated inwardly by the pneumatic actuator 74 to the dotted outline position illustrated in FIG. 2 so as to support the first edge of the thus dropped pallet. The pallet is clamped between the wedges 52 and 54 and the workpiece mounted therein is moved underneath the reciprocating needle 50 of the sewing machine. The carriage 46 returns to a position below the shelf 20 and will proceed to unlock the clamped pallet and drop the same if the previous pallet 16 has been removed from the chutes 84 and 86 as indicated by an open switch condition of the contact switch 92. In this manner, pallets may be processed from the input location defined by the shelves 20 and 22 through the sewing location defined by the carriage 46 to the output position defined by the chutes 84 and 86.

It is to be appreciated that, access may be required to various portions of the automatic positioning system as well as the structure associated with the sewing machine 10. This is easily accomplished by removing one or both of the supports 87 and 88 from their respective locations in a manner which will now be described. Each support is attached by a pair of clips such as 100 and 102 which engage pins 104 and 106 extending upwardly from the base 15. These clips may be withdrawn from underneath the heads of the pins so as to allow the corresponding support to be removed from the base 15. This allows access to both the positioning system associated with the carriage 46 as well as to the sewing machine 10.

Figure 5:
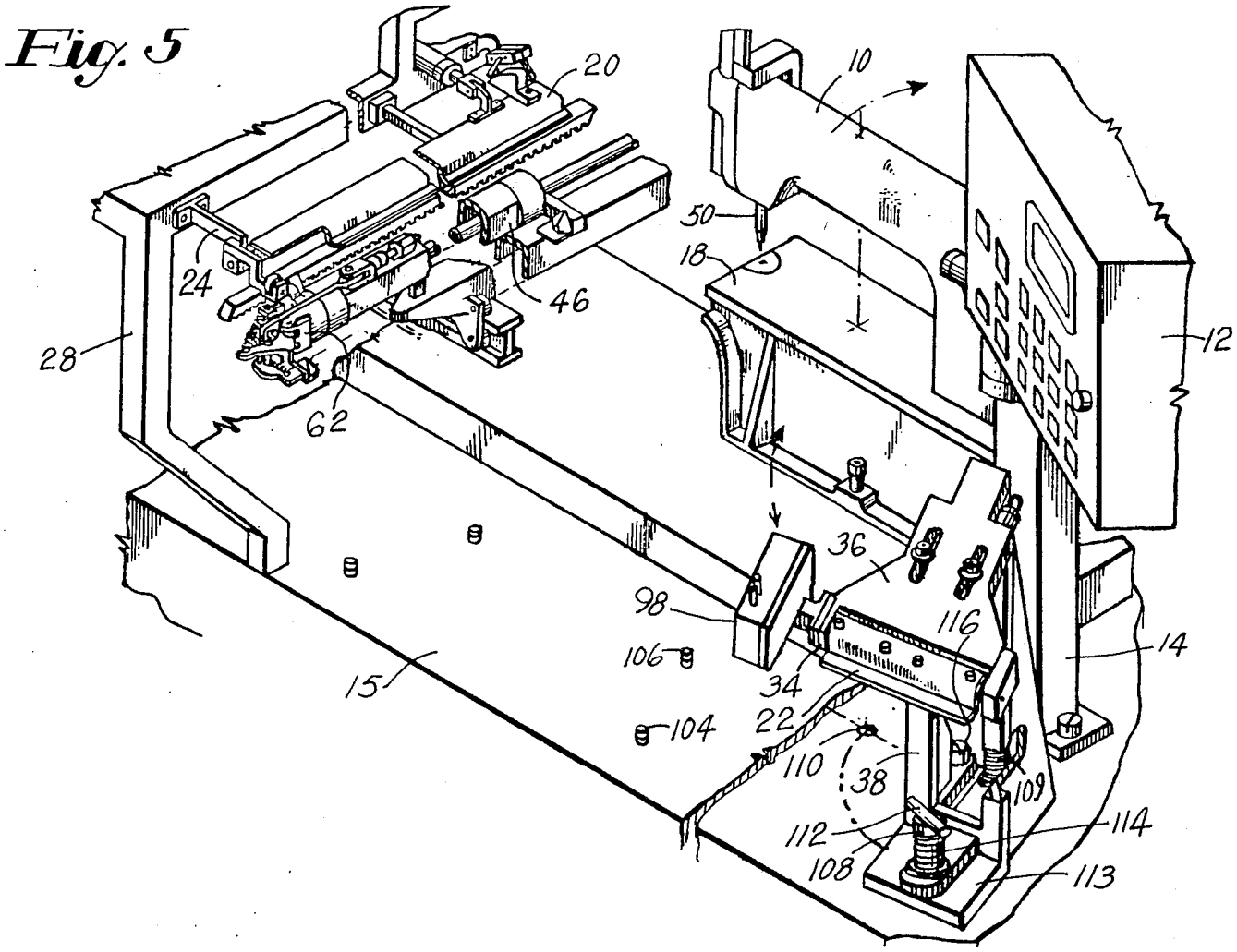
FIG. 5 is a perspective view of a disassembled pallet handling apparatus illustrating access to various portions of the automatic sewing system.

Referring to FIG. 5, it is seen that both of the supports have been removed from the base 15. The vertical support structure 38 has also been displaced from its normal location so as to allow even further access to the sewing machine 10. The displacement of the vertical support structure 38 is facilitated by loosening a pair of holding bolts 108 and 109 from threaded engagement with threaded holes such as 110 in the base 15. The holding bolts are easily loosened by grasping turning pins such as 112 located in the head of each holding bolt. The holding bolts are also spring loaded against a bottom rectangular portion 113 of the vertical support structure 38 by bias springs such as 114. This allows the holding bolts to extend upwardly from the bottom portion of the vertical support structure in such a manner as to allow access to the turning pins when initially loosening the holding bolts. The vertical support structure 38 is now free to pivot about a shoulder bolt 116 located in a corner of the bottom rectangular portion 113. This corner is seen to be located near the panel support 14. It is to be appreciated that the periphery of this corner must clear the panel support 14 when the vertical support 38 is pivoted about the shoulder bolt 116. This is accomplished by locating the threaded hole in the base 15 for the shoulder bolt at a distance from the panel support which is greater than the radial distance from the center of the shoulder bolt 116 to the extreme corner periphery of the corner in which the shoulder bolt is located. Location of the threaded hole for the shoulder bolt 116 also defines the hole locations for the holding bolts 108 and 109.

From the foregoing, it is to be appreciated that a preferred embodiment of certain pallet handling apparatus for an automatic sewing machine system has been disclosed. It is also to be appreciated that alternative structures may be substituted for elements of the preferred embodiment without departing from the scope of the invention.

WHAT IS CLAIMED:

1. Apparatus for processing workpieces prearranged within pallets in an automatic sewing machine system, said apparatus comprising:

a set of means for receiving opposing edges of a pallet, at least one of said receiving means being rotatably attached to a structural mount, said structural mount being pivotally attached to a base of the automatic sewing machine system so as to allow said structural mount to be pivotally displaced from its normal position;

means, located below said set of receiving means, for automatically attaching a pallet, dropped from said receiving means, to a means for automatically positioning the prearranged workpiece within the pallet relative to a sewing needle so as to produce a sewn workpiece;

means for dropping the front edge of the pallet containing the sewn workpiece from said means for automatically positioning the prearranged workpiece; and means for receiving the dropped pallet whereby the dropped front of the pallet slides downwardly so as to allow the rear edge of the pallet to thereafter drop from said means for automatically positioning the prearranged workpiece.

2. The apparatus of claim 1 wherein said structural mount which is pivotally attached to the base of said automatic sewing machine system comprises:

a frame extending upwardly from the base of the automatic sewing machine system to a location above the bed of the automatic sewing machine;

means for rotatably attaching one of said receiving means to said frame at the location above the bed of the automatic sewing machine; and means for pivotally attaching the opposite end of said frame to the base of said automatic sewing machine system whereby said frame may be pivoted about said pivotally attaching means so as to provide access to the automatic sewing machine.

3. The apparatus of claim 2 further comprising:

at least one bolt spring loaded against the opposite end of said frame and threadably engaging a hole in the base of said automatic sewing machine system so as to normally maintain the frame in a fixed position.

4. The apparatus of claim 3 further comprising:

means associated with each bolt, for allowing each bolt to be rotated by hand so as to thereby disengage the bolt from threaded engagement with the corresponding hole in the base of said automatic sewing machine system.

5. The apparatus of claim 1 wherein said structural mount which is pivotally attached to a base for the automatic sewing machine system comprises:

a bottom portion having a surface resting on the base of the automatic sewing machine system; and means for pivotally attaching a corner of the bottom portion to the base of said automatic sewing machine system whereby said structural mount may be pivoted about said corner pivotal attachment.

6. The apparatus of claim 5 wherein the location of said corner pivotal attachment to the base of said automatic sewing machine system is spaced at a predefined distance from a structural support for a control panel for the automatic sewing machine system.

7. The apparatus of claim 5 further comprising:

at least one bolt spring loaded against the top surface of said bottom portion and threadably engaging a hole in the base of said automatic sewing machine system so as to normally maintain said structural mount in a fixed position.

8. The apparatus of claim 7 further comprising:

means associated with each bolt, for allowing each bolt to be rotated by hand so as to thereby disengage the bolt from threaded engagement with the corresponding hole in the base of said automatic sewing machine system.

9. The apparatus of claim 1 further comprising:

means for detachably mounting said receiving means to the base of said automatic sewing machine system.

10. The apparatus of claim 9 wherein said means for detachably mounting said receiving means comprises:

means for supporting said means for receiving the pallet at a predefined angle relative to the base of the automatic sewing machine system; and means, extending through holes in said supporting means, for attaching said supporting means to the base of said automatic sewing machine system.

11. The apparatus of claim 10 wherein said means for attaching said supporting means comprises:

means, extending upwardly from the base of said automatic sewing machine system for engaging the holes in said supporting means; and means for removably fastening said supporting means to said means for engaging the holes in said supporting means.

* * * * *